United States Patent [19]

Anzinger et al.

[11] Patent Number: 4,772,289

[45] Date of Patent: Sep. 20, 1988

[54] PRIMER FOR LEATHER FINISHES

[75] Inventors: Hermann Anzinger, Duesseldorf; Hans-Herbert Friese, Monheim; Gerhard Kaindl; Michael Marschner, both of Hilden; Uwe Ploog, Haan; Ludwig Schieferstein, Ratingen; Horst Schulz, Krefeld; Rolf Tenhaef, Duesseldorf, all of Fed. Rep. of Germany

[73] Assignee: Henkel Kommanditgesellschaft auf Aktien, Duesseldorf, Fed. Rep. of Germany

[21] Appl. No.: 78,499

[22] Filed: Jul. 28, 1987

[30] Foreign Application Priority Data

Jul. 28, 1986 [DE] Fed. Rep. of Germany ..... 3625442

[51] Int. Cl.[4] ..... C14C 5/00; C14C 11/00

[52] U.S. Cl. ..... 8/94.23; 8/94.21; 8/94.2; 427/323

[58] Field of Search ..... 8/94.21, 94.23, 94.2; 428/304.4, 473, 389; 427/323

[56] References Cited

U.S. PATENT DOCUMENTS 3,941,733 3/1976 Chang ..... 428/304.4

FOREIGN PATENT DOCUMENTS 2526559 1/1976 Fed. Rep. of Germany ..... 8/94.21

OTHER PUBLICATIONS

D. Dietrich, Angew. Makrom. Chem., 98, 133 (1981).
"Des Leder" 25, 167–171 (1974).

*Primary Examiner*—Paul Lieberman
*Assistant Examiner*—John F. McNally
*Attorney, Agent, or Firm*—Ernest G. Szoke; Henry E. Millson, Jr.

[57] ABSTRACT

A process for improving the adhesion of finishes to oiled and/or hydrophobicized leathers wherein oiled and/or hydrophobicized leathers are treated before prefinishing and/or in the prefinish with aqueous dispersions containing (A) short-chain and/or medium-chain alkyl ether phosphates and (B) finely divided, soft, urea-group-terminated, aliphatic anionic polyurethane dispersions.

7 Claims, No Drawings

PRIMER FOR LEATHER FINISHES

BACKGROUND OF THE INVENTION

1. Field of the Invention

This invention relates to a process for improving the adhesion of finishes on oiled and/or hydrophobicized leathers and to the use of aqueous dispersions as a primer for improving the adhesion of finishes on oiled and/or hydrophobicized leathers.

2. Statement of Related Art

A leather finish is the protective layer applied to the leather dried after tanning in oiling to protect it against moisture, soiling and damage. An optimal finish is required inter alia to adhere firmly to the leather. Unfortunately, most finishes do not satisfactorily fulfill this requirement. Thus, polyurethane-based finishes for example give good fastness values and flexibilities so that the finish film is virtually impossible to break; unfortunately, adhesion problems frequently arise with finishes of this type (cf. "Das Leder" 25, 167–171 (1974)). In the case of hydrophobicized leathers, there is the further difficulty that any improvement in adhesion is often accompanied by a deterioration in the hydrophobicization.

The weakly crosslinking aqueous polyurethane dispersions leather finishes also fail to satisfactorily meet the demands made of them.

STATEMENT OF THE INVENTION

Other than in the operating examples, or where otherwise indicated, all numbers expressing quantities of ingredients or reaction conditions used herein are to be understood as modified in all instances by the term "about".

Accordingly, an object of the present invention is to provide a primer for improving the adhesion of leather finishes.

It has now surprisingly been found that aqueous dispersions containing (A) short-chain and/or medium-chain alkyl ether phosphates and (B) finely divided, soft, urea-group-terminated, aliphatic anionic polyurethane dispersions form a very good primer on oiled and/or hydrophobicized leathers for the subsequent finishing processes. It has also been found that, in the case of hydrophobicized leathers, the improvement in the adhesion of the finish is not accompanied by the adverse effect on the hydrophobicization.

Accordingly, the present invention relates to a process for improving the adhesion of finishes on oiled and/or hydrophobicized leathers wherein oiled and/or hydrophobicized leathers are treated before prefinishing and/or in the prefinish with aqueous dispersions containing (A) at least one short-chain and/or medium-chain alkyl ether phosphate, and (B) at least one finely divided, soft, urea-group-terminated, aliphatic anionic polyurethane dispersion.

The alkyl ether phosphates in the aqueous dispersions of the invention preferably contain from 2 to 12 carbon atoms in the branched and/or unbranched alkyl chains and from 2 to 6 alkylene oxide units in the ether chains. Alkyl ether phosphates containing from 2 to 6 ethylene oxide and/or propylene oxide units in the ether chains are particularly preferred.

The alkyl ether phosphates are prepared in known manner by phosphatization of alkoxylated, particularly ethoxylated and/or propoxylated, primary, secondary and/or tertiary, straight-chain and/or branched-chain aliphatic alcohols containing from 2 to 12 carbon atoms.

"Alkyl ether phosphates" are understood to be mono-, di-and/or trialkyl ether phosphates, depending on the production conditions. Mono-, di- and/or trialkyl ether phosphates, preferably mono- and/or dialkyl ether phosphates, are used in accordance with the invention.

The finely divided, soft, urea-group-terminated, aliphatic anionic polyurethane dispersions suitable for the process of the invention are prepared in known manner (see for example *D. Dieterich* in Angew. Makrom. Chem. 98, 133 (1981) and the literature cited therein), for example by reacting aliphatic polyisocyanates with sub-stoichiometric quantities of polyol in the melt in an inert gas atmosphere to form the corresponding prepolymers. A substoichiometric quantity of monobasic and/or polybasic polyhydroxy carboxylic acids in the form of their alkali, amine and/or ammonium salts, dissolved in an inert solvent, is then added to the prepolymers. After the reaction solution has been boiled under reflux for about 1 to 3 hours, the solvent is removed in vacuo and the polyurethane mass is dispersed first in water and then in aqueous solutions containing amines and/or ammonia. The resulting dispersion usually contain from 25 to 50% by weight solids.

Suitable aliphatic polyisocyanates are in particular cyclic and/or non-cyclic diisocyanates, for example 1,6-hexamethylene diisocyanate, trimethyl-1,6-hexamethylene diisocyanate and/or 3-isocyanatomethyl-3,5,5-trimethyl cyclohexyl isocyanate (isophorone diisocyanate).

The second component required for the production of the prepolymers, namely the polyols, are preferably polyester and/or polyether diols known from polyurethane chemistry containing at least two alcoholic hydroxyl groups and having a molecular weight of from 400 to 3000 and preferably of from 800 to 2000. Difunctional polypropylene glycols are particularly preferred.

Suitable monobasic and/or polybasic polyhydroxycarboxylic acids are, for example, dihydroxypropionic acid, dimethylol propionic acid, dihydroxysuccinic acid and/or dihydroxybenzoic acid. 2,2-dimethylol propionic acid is preferably used.

Particularly suitable solvents for the above-mentioned polyhydroxycarboxylic acids, which are used in the form of their alkali metal, amine and/or ammonium salts, are acetone and/or N-methyl pyrrolidone.

The priming liquors used in the process of the invention preferably contain 1 part by weight of the polyurethane dispersion characterized above to 2–20 parts by weight water and more preferably to 4–15 parts by weight water. It has been found that aqueous dispersions in which the ratio by weight of component A to component B is from 2:1 to 1:10 are particularly advantageous for improving the adhesion of leather finishes. Mixtures in which the ratio by weight of component A to component B is from 1:1 to 1:5 are particularly preferred.

In the process of the invention, the priming liquors containing components A and B are sprayed or poured, preferably sprayed, onto oiled and/or hydrophobicized leathers.

The present invention also relates to the use of aqueous dispersions of the invention as a primer for improving the adhesion of finishes on oiled and/or hydrophobicized leathers.

In order to obtain an improvement in the adhesion of finishes, it is also possible in some cases to spray or pour, preferably spray, only part of the priming liquor onto the oiled and/or hydrophobicized leather and to use the other part in the pre-finishing liquor. In cases such as these, the proportion of polyurethane dispersion in the pre-finishing liquor is from 1 to 50 parts by weight and preferably from 2 to 30 parts by weight per 100 parts by weight binder in the pre-finishing liquor. As stated above, the ratio by weight of component A to component B is preferably from 2:1 to 1:10 and more preferably from 1:1 to 1:5. "Binders" are understood to be, for example, acrylate, acrylonitrile, polybutadiene and/or polyurethane dispersions.

The aqueous dispersions of the invention form a very good primer on oiled and/or hydrophobicized leathers for the subsequent finishing processes. The mixtures penetrate very deeply into the leather, so that no sticking problems arise during ironing and stacking in the course of the finishing processes. In addition, the process of the invention and the use in accordance with the invention of the aqueous dispersions chracterized above provide a very good primer on hydrophobicized leathers without any adverse effect on the hydrophobicization.

The invention will be illustrated but not limited by the following examples.

EXAMPLES

Preparation of polyurethane dispersion I 26.3 parts by weight polypropylene glycol having a molecular weight of approximately 1000 and 8.95 parts by weight 1,6-hexamethylene diisocyanate were mixed at room temperature in a stirring apparatus and stirred under nitrogen for about 6 hours at 100° C. The storable isocyanate prepolymer obtained was cooled to around 50° C., followed by the addition at that temperature of a freshly prepared solution of 1.77 parts by weight 2,2-dimethylol propionic acid and 1.33 parts by weight triethylamine in 9.42 parts by weight acetone. The reaction mixture was refluxed for 1.5 hours at around 100° C. After approximately 8.5 parts by weight acetone have been removed in vacuo in about 10 to 15 minutes at 100° C., the reaction mixture was cooled to around 70° C. and then dispersed with extremely vigorous stirring in 59.0 parts by weight water. 1.73 parts by weight of a 12.5% $NH_3/H_2O$ solution were then added to the dispersion, followed by stirring for about 1 hour at 50° C.

The polyurethane dispersion obtained has the following characteristics:

Solids content: 39% by weight
ph value: 7.0
Particle diameter: 58 to 80 nm
Film: clear, soft, highly tacky.

APPLICATION EXAMPLES

The adhesion tests were carried out in accordance with IUF 470.

| EXAMPLE 1 | | Apparel hide, hydrophobicized |
|---|---|---|
| Primer: | 100 | parts by weight polyurethane dispersion I |
| | 30 | parts by weight $C_3$–$C_8$ alkyl-2-4 EO-phosphate |
| | 570 | parts by weight water spray 1× |
| Pre-finish: | 5 | parts by weight polyurethane dispersion I |
| | 70 | parts by weight pigment |

-continued

| EXAMPLE 1 | | Apparel hide, hydrophobicized |
|---|---|---|
| | 30 | parts by weight ironing aid based on a wax dispersion |
| | 80 | parts by weight polybutadiene dispersion |
| | 150 | parts by weight acrylonitrile copolymer dispersion |
| | 30 | parts by weight silica-based delustrant |
| | 350 | parts by weight water spray 3× |
| Finish: | 150 | parts by weight water |
| | 100 | parts by weight nitrocellulose emulsion |
| | 25 | parts by weight silica-based delustrant spray 2× |

EXAMPLES 2

(Comparison)

As Example 1, but without primer and without polyurethane dispersion I in the pre-finish.

Adhesion testing produced the following values:
Example 1: 2.4 N/cm
Example 2: 1.3 N/cm

| EXAMPLE 3 | | Hide upper, hydrophobicized |
|---|---|---|
| Primer: | 10 | parts by weight polyurethane dispersion I |
| | 2 | parts by weight $C_6$–$C_{12}$ alkyl-4-6 PO-phosphate |
| | 100 | parts by weight water spray 1× |
| Pre-finish | 100 | parts by weight pigment (casein-containing) |
| | 160 | parts by weight acrylate dispersion |
| | 80 | parts by weight polybutadiene dispersion |
| | 5 | parts by weight polyurethane dispersion I |
| | 5 | parts by weight wax-based ironing aid |
| | 10 | parts by weight silica-based delustrant |
| | 10 | parts by weight formalin |
| | | pad 1×, spray 1×, iron at 80° C./50 bar |
| Finish: | 100 | parts by weight nitrocellulose emulsion |
| | 100 | parts by weight water spray 1× |
| | | iron onto Finiflex |

EXAMPLE 4

(Comparison)

As Example 3, but without primer and without polyurethane dispersion I in the pre-finish.

Adhesion testing produces the following values:
Example 3: 4.0 N/cm
Example 4: 1.8 N/cm

| EXAMPLE 5 | | Upholstery pigskin |
|---|---|---|
| Primer: | 100 | parts by weight polyurethane dispersion I |
| | 100 | parts by weight $C_8$-alkyl-4 EO-phosphate |
| | 800 | parts by weight water spray 1× |
| Pre-finish | 100 | parts by weight pigment |
| | 140 | parts by weight acrylate dispersion |
| | 20 | parts by weight wax-based ironing aid |
| | 50 | parts by weight polyurethane dispersion I |
| | 30 | parts by weight silica-based delustrant |
| | 300 | parts by weight water spray 5× |
| Finish | 100 | parts by weight nitrocellulose lacquer |
| | 200 | parts by weight butylacetate |
| | 10 | parts by weight silicone-based feel regulator spray 2× |

EXAMPLE 6

(Comparison)

As Example 5, but without primer.

Adhesion testing produces the following values:

Example 5: 3.4 N/cm

Example 6: 2.1 N/cm

We claim:

1. A method for improving the adhesion of finishes on oiled and/or hydrophobicized leathers, comprising treating such leathers before prefinishing and/or in the prefinish with an aqueous dispersion containing (A) at least one short-chain and/or medium-chain alkyl ether phosphate, and (B) at least one finely divided, soft, urea-group-terminated aliphatic anionic polyurethane dispersion.

2. The method of claim 1 wherein in component A the alkyl groups are branched and/or unbranched alkyl groups containing from 2 to 12 carbon atoms and wherein from 2 to 6 alkylene oxide groups are present.

3. The method of claim 2 wherein the alkylene oxide groups are ethylene oxide or propylene oxide or both.

4. The method of claim 1 wherein the aqueous dispersion contains from 1 part by weight of component B to from about 2 to about 20 parts by weight of water.

5. The method of claim 4 wherein from 1 part by weight of component B to about 4 to about 15 parts by weight of water are present.

6. The method of claim 1 wherein the ratio by weight of component A to component B is from about 2:1 to about 1:10.

7. The method of claim 6 wherein the ratio is from about 1:1 to about 1:5.

* * * * *